US007248099B2

(12) United States Patent
Kedilaya et al.

(10) Patent No.: US 7,248,099 B2
(45) Date of Patent: Jul. 24, 2007

(54) CIRCUIT FOR GENERATING REFERENCE CURRENT

(75) Inventors: Rajath Kedilaya, Karnataka (IN); Minsu Jeong, Gyeonggi-do (KR)

(73) Assignee: Integrant Technologies, Inc., Gyeonggi-do (KR)

( * ) Notice: Subject to any disclaimer, the term of this patent is extended or adjusted under 35 U.S.C. 154(b) by 38 days.

(21) Appl. No.: 11/303,921

(22) Filed: Dec. 19, 2005

(65) Prior Publication Data

US 2006/0132224 A1 Jun. 22, 2006

(30) Foreign Application Priority Data

Dec. 21, 2004 (KR) ..... 10-2004-0109643

(51) Int. Cl.
*G05F 1/10* (2006.01)
*G05F 3/02* (2006.01)

(52) U.S. Cl. ..... 327/539; 327/513

(58) Field of Classification Search ..... 327/539, 327/512–513; 323/313
See application file for complete search history.

(56) References Cited

U.S. PATENT DOCUMENTS 5,614,816 A * 3/1997 Nahas ..... 323/316
2005/0285666 A1* 12/2005 Garlapati et al. ..... 327/539
2006/0006858 A1* 1/2006 Chiu ..... 323/313

* cited by examiner

*Primary Examiner*—Quan Tra
(74) *Attorney, Agent, or Firm*—Foley & Lardner LLP

(57) ABSTRACT

Disclosed herein is a circuit for generating reference current. The circuit for generating reference current comprises a current providing unit for generate a PTAT current, mirroring the PTAT current to generate an analogous PTAT current and generate an analogous BGR current, a current ratio control unit for generating an analogous BGR current in a first ratio, a PTAT current in a second ratio, and a current corresponding to the difference between the analogous PTAT current in the second ratio and the analogous BGR current in the first ratio, and a current increasing/decreasing unit for generating a BGR current in the first ratio.

3 Claims, 7 Drawing Sheets

CIRCUIT FOR GENERATING REFERENCE CURRENT

BACKGROUND OF THE INVENTION

1. Field of the Invention

The present invention relates to a circuit for generating reference current, and more particularly, to a circuit for generating reference current for providing a band gap reference (BGR) current and a proportional to absolute temperature (PTAT) current using a single external pad.

2. Background of the Related Art

In general, a circuit for generating reference current for providing a constant current having a predetermined level is widely used in a bias circuit or an active load of an analog integrated circuit or an RF integrated circuit. Particularly, most analog integrated circuits use a bias mode based on the circuit for generating reference current. The circuit for generating reference current provides a band gap reference (BGR) current which can supply a constant current irrespective of a fabricating process or a surrounding temperature variation, and a proportional to absolute temperature (PTAT) current which can supply a current linearly proportional to absolute temperature.

FIG. 1 illustrates a conventional circuit for generating reference current 1. Referring to FIG. 1, the conventional circuit for generating reference current 1 generates a BGR current IBGR and a PTAT current IPTAT using two external pads P1 and P2 and two external resistors RBGR and RPTAT and provides them to an analog integrated circuit or an RF integrated circuit 2 as a reference current.

With the rapid development of information communications, an analog integrated circuit or an RF integrated circuit is required to operate at a high speed. Thus, techniques of manufacturing the analog integrated circuit or RF integrated circuit are being developed such that the integration, reliability and response speed of the analog integrated circuit or RF integrated circuit are improved. The increased integration of the analog integrated circuit or RF integrated circuit reduces its package size. To reduce the package size of the analog integrated circuit or RF integrated circuit requires a decrease in the number of external pads.

SUMMARY OF THE INVENTION

Accordingly, the present invention has been made to solve the above-mentioned problems, and it is an object of the present invention is to provide a circuit for generating reference current capable of providing a BGR current and a PTAT current using a single external pad.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To accomplish the above objects, according to the present invention, there is provided a circuit for generating reference current comprising: a current providing unit for generating a PTAT current, mirroring the PTAT current to generate an analogous PTAT current, and generating an analogous BGR current; a current ratio control unit for receiving the analogous BGR current, the PTAT current and the analogous PTAT current from the current providing unit to generate an analogous BGR current in a first ratio, a PTAT current in a second ratio and a current corresponding to the difference between the analogous PTAT current in the second ratio and the analogous BGR current in the first ratio; and a current increasing/decreasing unit for receiving the analogous BGR current in the first ratio, the PTAT current in the second ratio and the current corresponding to the difference between the analogous PTAT current in the second ratio and the analogous BGR current in the first ratio from the current ratio control unit, and increasing/decreasing the analogous BGR current in the first ratio, the PTAT current in the second ratio and the current corresponding to the difference between the analogous PTAT current in the second ratio and the analogous BGR current in the first ratio to generate a BGR current in the first ratio.

Preferably, the current ratio control unit comprises cascode current mirrors each of which includes MOS transistors. The ratio of the channel widths of the MOS transistors of each cascode current mirror is controlled to provide the analogous BGR current in the first ratio, the PTAT current in the second ratio and the current corresponding to the difference between the analogous PTAT current in the second ratio and the analogous BGR current in the first ratio.

Preferably, the current increasing/decreasing unit comprises a current multiplier, including MOS transistors operated in a sub-threshold region.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
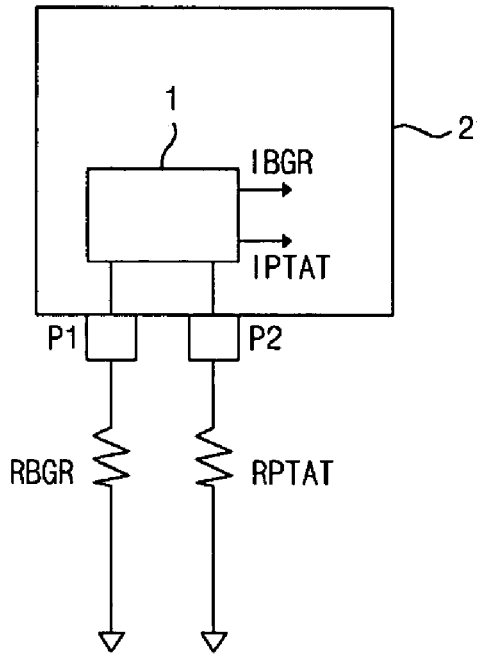
FIG. 1 illustrates a conventional circuit for generating reference current.

Reference will now be made in detail to the preferred embodiments of the present invention, examples of which are illustrated in the accompanying drawings. Throughout the drawings, like reference numerals refer to like elements.

Figure 2:
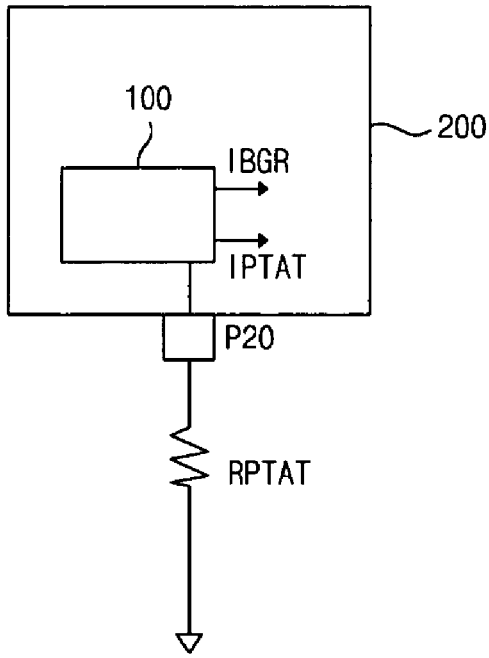
FIG. 2 illustrates a circuit for generating reference current according to an embodiment of the present invention.

FIG. 2 illustrates a circuit for generating reference current 100 according to an embodiment of the present invention. Referring to FIG. 2, the circuit for generating reference current 100 generates a BGR current IBGR and a PTAT current IPTAT using a single external pad P20 and a single external resistor RPTAT and provides them to an analog integrated circuit or an RF integrated circuit 200 as a reference current. Accordingly, the circuit for generating reference current 200 of the present invention can reduce the number of external pads to effectively decrease the package size and the package fabricating costs of the analog integrated circuit or the RF integrated circuit 200.

Figure 3:
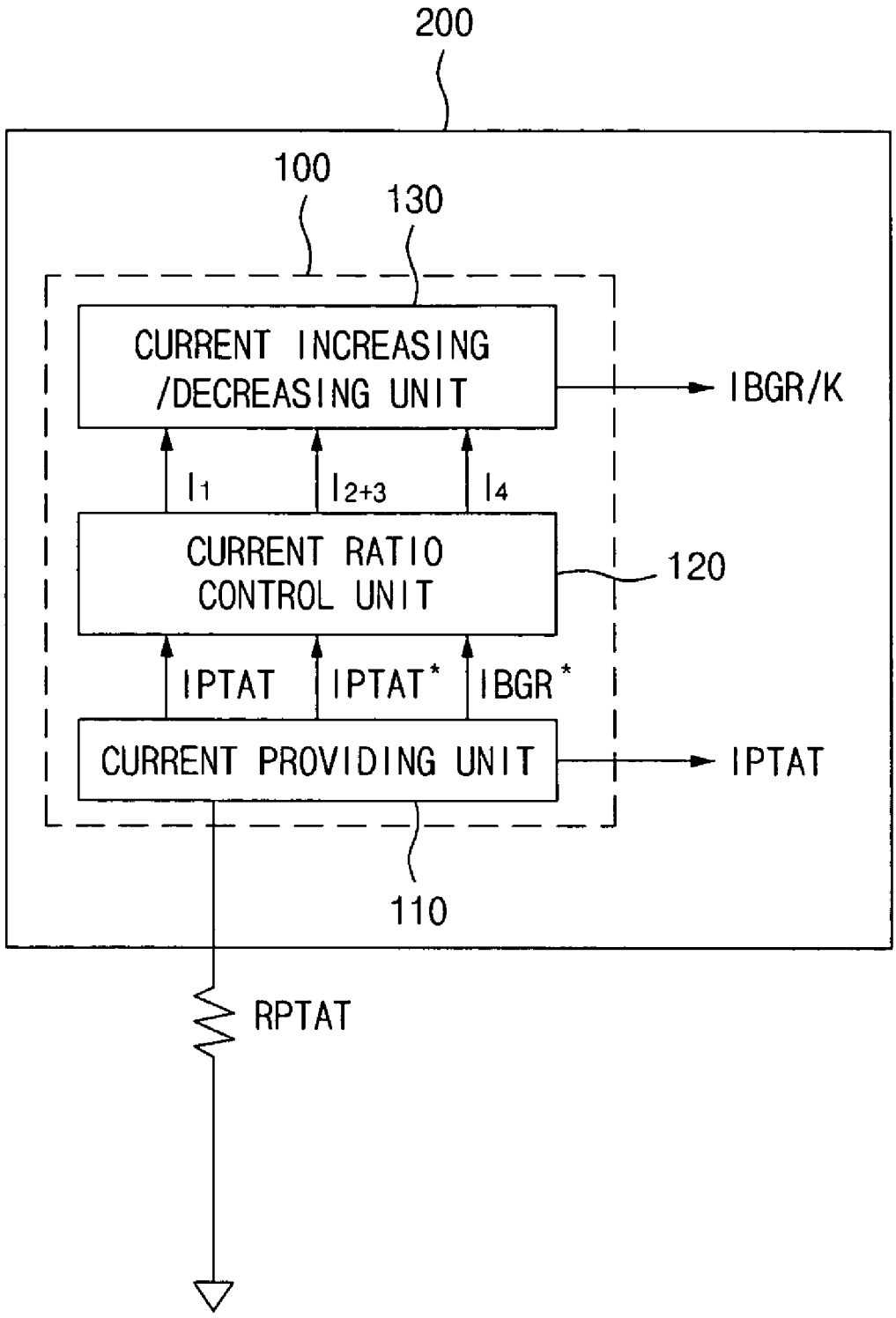
FIG. 3 is a block diagram of the circuit for generating reference current according to an embodiment of the present invention.

FIG. 3 is a block diagram of the circuit for generating reference current 200 according to an embodiment of the present invention.

Referring to FIG. 3, the circuit for generating reference current 200 comprises a current providing unit 110, a current ratio control unit 120 and a current increasing/decreasing unit 130.

The current providing unit 110 provides the PTAT current IPTAT and an analogous BGR current IBGR* and mirrors the PATA current IPTAT to provide an analogous PTAT current IPTAT*.

The current ratio control unit 120 receives the analogous BGR current IBGR*, the PTAT current IPTAT and the analogous PTAT current IPTAT* and provides an analogous BGR current in a first ratio IBGR*/k1, a PTAT current in a second ratio IPTAT/k2, and a current IPTAT*/k2-IBGR*/k1 corresponding to the difference between the analogous PTAT current in the second ratio IPTAT*/k2 and the analogous BGR current in the first ratio IBGR*/k1.

The current increasing/decreasing unit 130 receives the analogous BGR current in the first ration IBGR*/k1, the PTAT current in the second ratio IPTAT/k2 and the difference current IPTAT*/k2-IBGR*/k1 between the analogous PTAT current in the second ratio IPTAT*/k2 and the analogous BGR current in the first ratio IBGR*/k1 from the current ratio control unit 120 and increases/decreases them to provide a BGR current in the first ratio IBGR/k1.

Figure 4:
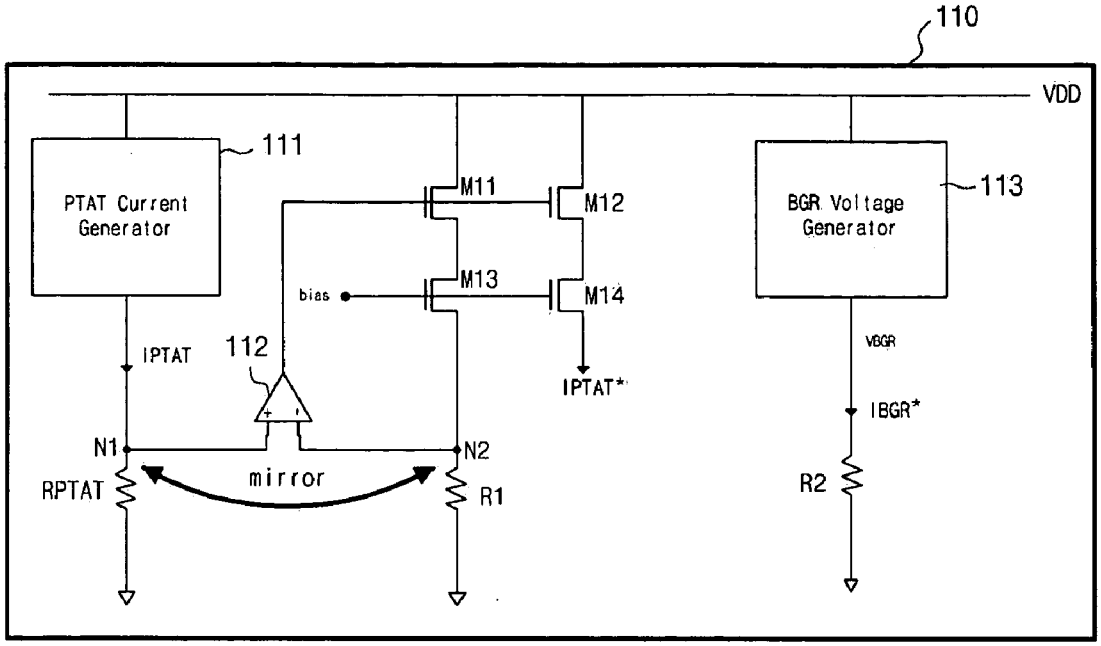
FIG. 4 illustrates a current providing unit of the circuit for generating reference current according to an embodiment of the present invention.
Figure 5A:
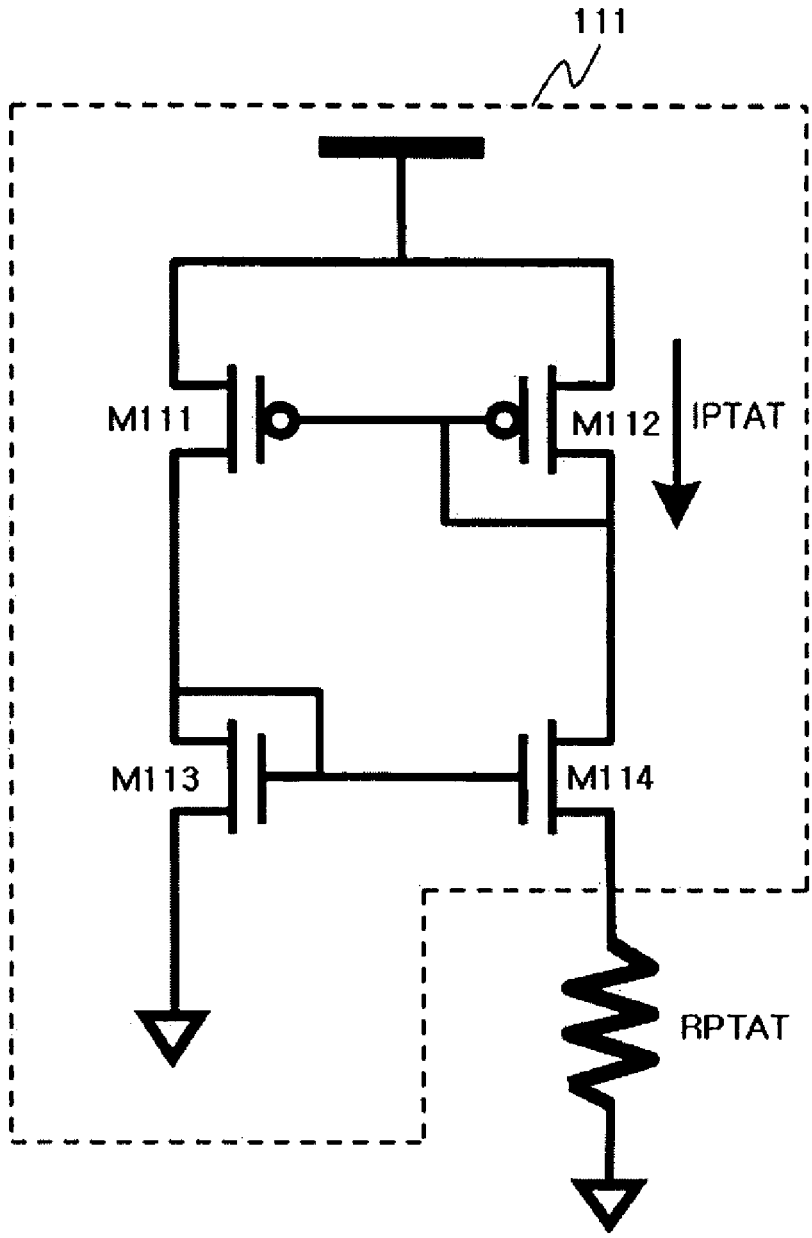
FIG. 5A is a circuit diagram of a PTAT current generator of the current providing unit of FIG. 4.
Figure 5B:
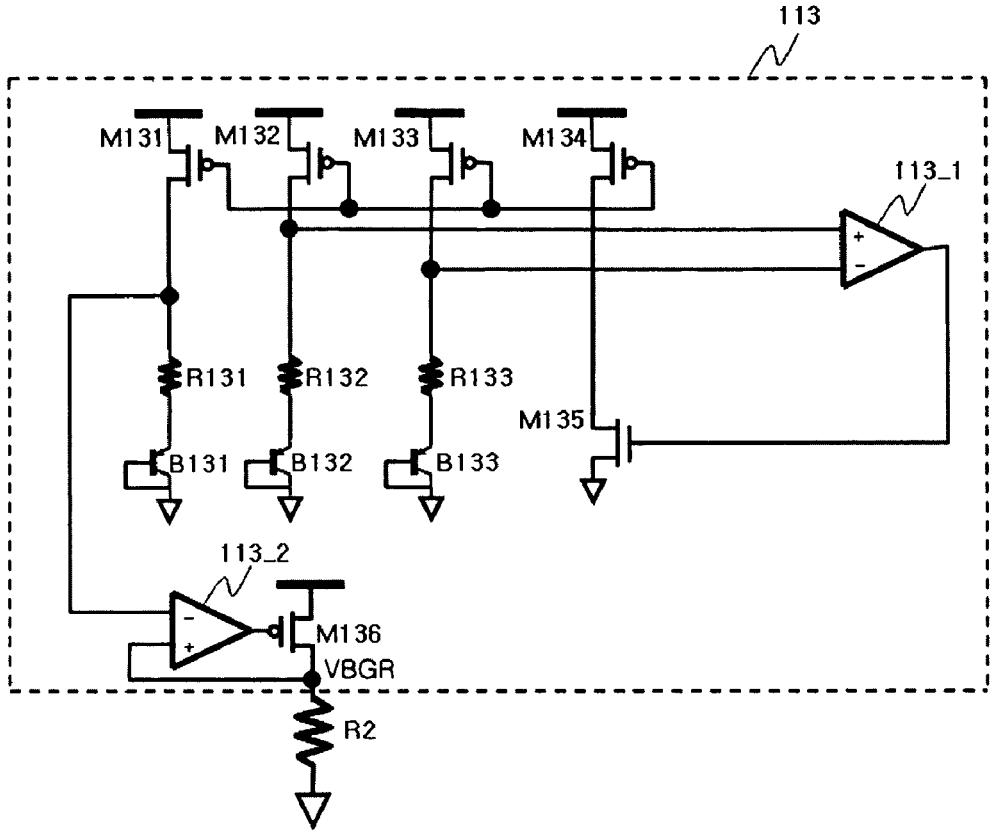
FIG. 5B is a circuit diagram of a BGR voltage generator of the current providing unit of FIG. 4.

FIG. 4 illustrates the current providing unit 110 of the circuit for generating reference current according to an embodiment of the present invention, FIG. 5A is a circuit diagram of a PTAT current generator 111 of the current providing unit 110 of FIG. 4, and FIG. 5B is a circuit diagram of a BGR voltage generator 113 of the current providing unit 110 of FIG. 4.

Referring to FIG. 4, the current providing unit 110 generates the PTAT current IPTAT using the PTAT current generator 111 and an external resistor RPTAT. Here, the PTAT current IPTAT is linearly proportional to absolute temperature. In addition, the current providing unit 110 mirrors the voltage of a node N2 of an internal resistor R1 to the voltage of a node N1 of the external resistor RPTAT using an operational amplifier 112 and provides the analogous PTAT current IPTAT* using MOS transistors M11, M12, M13 and M14.

The gates of the MOS transistor M11 and M12 are connected to the output port of the operational amplifier 112. The drains of the MOS transistors M13 and M14 are respectively connected to the sources of the MOS transistor M11 and M12 and the gates of the MOS transistors M13 and M14 are provided with a bias voltage. Here, the bias voltage is provided such that the MOS transistors M13 and M14 are operated in a saturation region.

In the PTAT current generator 111, as shown in FIG. 5A, two MOS transistors M111 and M112 are coupled to each other to construct a current mirror and two MOS transistors M113 and M114 are coupled to each other to form a current mirror. The drain of the MOS transistor M111 is connected to the drain of the MOS transistor M113, and the drain of the MOS transistor M112 is connected to the drain of the MOS transistor M114. The sources of the MOS transistors M111 and M112 are connected to a power supply voltage and the source of the MOS transistor M113 is connected to a ground voltage. Accordingly, the PTAT current generator 111 provides the PTAT current IPTAT to the external resistor RPTAT.

The BGR voltage generator 113 provides a constant voltage VBGR irrespective of a variation in a fabrication process or surrounding temperature and generates the analogous BGR current IBGR* using the constant voltage VBGR and an internal resistor R2. Here, the resistance value of the internal resistor R1 is identical to the resistance value of the internal resistor R2.

In the BGR voltage generator 113, as shown in FIG. 5B, the drain of a MOS transistor M131 is connected to a resistor R131 coupled to the emitter of a bipolar transistor B131. The base and collector of the bipolar transistor B131 are connected to each other. The drain of a MOS transistor M132 is connected to a resistor R132 coupled to the emitter of a bipolar transistor B132. The base and collector of the bipolar transistor B132 are connected to each other. The drain of a MOS transistor M133 is connected to a resistor R133 coupled to the emitter of a bipolar transistor B133. The base and collector of the bipolar transistor B133 are connected to each other. The drain of a MOS transistor M134 is connected to the drain of a MOS transistor M135. The gates of the MOS transistors M131, M132, M133 and M134 are connected, and the sources of the MOS transistors M131, M132, M133, M134 and M135 are connected to the power supply voltage. The drain of the MOS transistor M132 is connected to the positive input port (+) of an operational amplifier 113_1 and the drain of the MOS transistor M133 is connected to the negative input port (−) of the operational amplifier 113_1. The gate of the MOS transistor M135 is connected to the output port of the operational amplifier 113_1. The collectors of the bipolar transistors B131, B132 and B133 are connected to the ground voltage. The drain of the MOS transistor M131 is connected to the negative input port (−) of an operational amplifier 113_2 and the drain of a MOS transistor M136 is connected to the positive input port (+) of the operational amplifier 113_2. The gate of the MOS transistor M136 is connected to the output port of the operational amplifier 113_2. With this configuration, the BGR voltage generator 113 generates the constant voltage VBGR.

Figure 6:
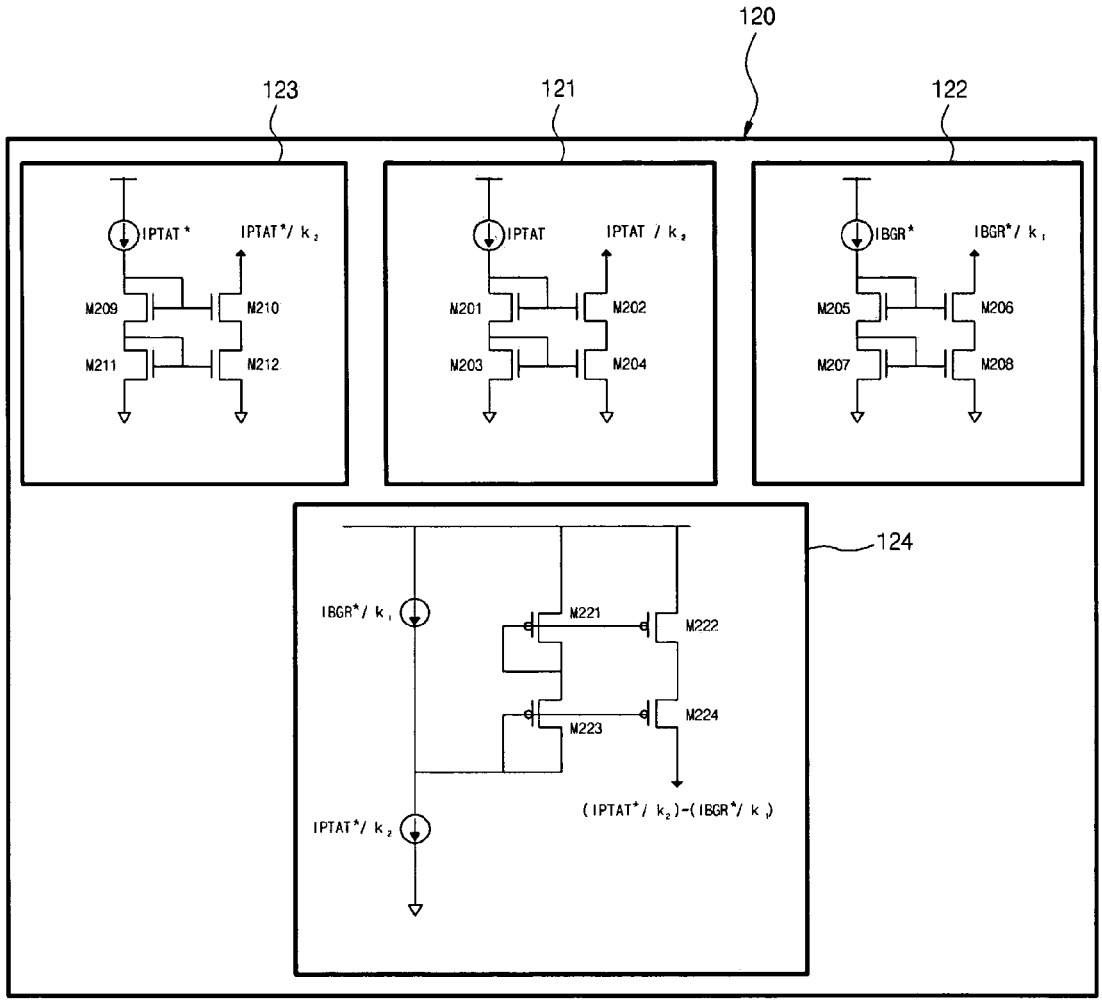
FIG. 6 is a circuit diagram of a current ratio control unit of the circuit for generating reference current according to an embodiment of the present invention.

FIG. 6 is a circuit diagram of the current ratio control unit 120 of the circuit for generating reference current according to an embodiment of the present invention. Referring to FIG. 6, the current ratio control unit 120 includes a first cascode current mirror 121, a second cascode current mirror 122, a third cascode current mirror 123 and a fourth cascode current mirror 124.

The first cascode current mirror 121 is constructed in such a manner that two MOS transistors M201 and M202 are connected in a current mirror, two MOS transistors M203 and M204 are connected in a current mirror, and the current mirror composed of the MOS transistors M201 and M202 and the current mirror composed of the MOS transistors M203 and M204 are cascode-connected. The four MOS transistors M201, M202, M203 and M204 have the same channel length. The channel widths of the MOS transistors M201 and M203 are k2 times the channel widths of the MOS transistors M202 and M204. Accordingly, when the PTAT current IPTAT generated by the current providing unit 110 is transmitted to the drain of the MOS transistor M201, the PTAT current in the second ratio IPTAT/k2 is provided to the drain of the MOS transistor M202. Here, the ratio of the PTAT current IPTAT provided by the first cascode current mirror 121 can be easily controlled by making the four MOS transistors M201, M202, M203 and M204 have the same channel length and adjusting the ratio of the channel widths of the MOS transistors M201 and M203 to the channel widths of the MOS transistors M202 and M204. That is, when the ratio of the channel widths of the MOS transistors M201 and M203 to the channel widths of the MOS transistors M202 and M204 is k3, the first cascode current mirror 121 provides a PTAT current in a third ratio IPTAT/k3.

The second cascode current mirror 122 is constructed in such a manner that two MOS transistors M205 and M206 are connected in a current mirror, two MOS transistors M207 and M208 are connected in a current mirror, and the current mirror composed of the MOS transistors M205 and M206 and the current mirror composed of the MOS transistors M207 and M208 are cascode-connected. The four MOS transistors M205, M206, M207 and M208 have the same channel length, and the channel widths of the MOS transistors M205 and M207 are k1 times those of the MOS transistors M206 and M208. Accordingly, when the analogous BGR current IBGR* provided by the current providing unit 110 is transmitted to the drain of the MOS transistor M205, the analogous BGR current in the first ratio IBGR*/k1 is provided to the drain of the MOS transistor M206.

The third cascode current mirror 123 is constructed in such a manner that two MOS transistors M209 and M210 are connected in a current mirror, two MOS transistors M211 and M212 are connected in a current mirror, and the current mirror composed of the MOS transistors M209 and M210 and the current mirror composed of the MOS transistors M211 and M212 are cascode-connected. The four MOS transistors M209, M210, M211 and M212 have the same channel length, and the channel widths of the MOS transistors M209 and M211 are k2 times those of the MOS transistors M210 and M212. Accordingly, when the analogous PTAT current IPTAT* generated by the current providing unit 110 is transmitted to the drain of the MOS transistor M209, the analogous PTAT current in the second ratio IPTAT*/k2 is provided to the drain of the MOS transistor M210.

The fourth cascode current mirror 124 is constructed in such a manner that two MOS transistors M221 and M222 are connected in a current mirror, two MOS transistors M223 and M224 are connected in a current mirror, and the current mirror composed of the MOS transistors M221 and M222 and the current mirror composed of the MOS transistors M223 and M224 are cascode-connected. The four MOS transistors M221, M222, M223 and M224 have the same channel length and the same channel width. Accordingly, when the analogous BGR current in the first ratio IBGR*/k1 provided by the second cascode current mirror 122 is transmitted to a node between the source of the MOS transistor M221 and the drain of the MOS transistor M223 and the analogous PTAT current in the second ratio IPTAT*/k2 provided by the third cascode current mirror 123 is transmitted to a node between the drain of the MOS transistor M223 and a ground electrode, the current IPTAT*/k2-IBGR*/k1 corresponding to the difference between the analogous PTAT current in the second ratio IPTAT*/k2 and the analogous BGR current in the first ratio IBGR*/k1 is supplied to the drain of the MOS transistor M224.

Figure 7:
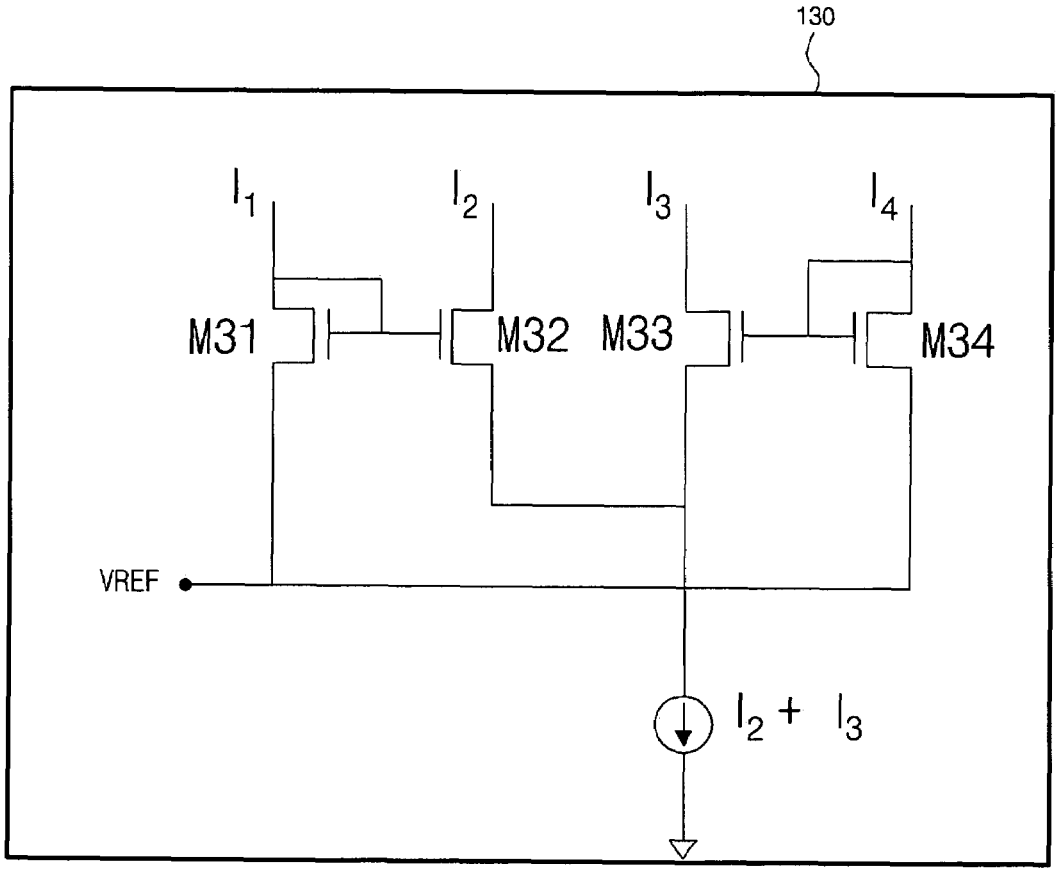
FIG. 7 is a circuit diagram of a current increasing/decreasing unit of the circuit for generating reference current according to an embodiment of the present invention.

FIG. 7 is a circuit diagram of the current increasing/decreasing unit 130 of the circuit for generating reference current according to an embodiment of the present invention. Referring to FIG. 7, the current increasing/decreasing unit 130 uses a current multiplier operated in a sub-threshold region. Specifically, the current multiplier is constructed such that two MOS transistors M31 and M32 are connected in a current mirror, two MOS transistors M33 and M34 are connected in a current mirror, and the sources of the four MOS transistors M31, M32, M33 and M34 are connected. A current source $I_2+I_3$ is applied between the sources of the four MOS transistors M31, M32, M33 and M34 and the ground electrode, and a reference voltage VREF is applied to the sources of the MOS transistors M31, M32, M33 and M34. Here, the reference voltage VREF is provided such that the current source $I_2+I_3$ is operated in a saturation region.

The relationship among the BGR current IBGR, the analogous BGR current IBGR* generated using the internal resistor R2, the analogous PTAT current IPTAT* generated using the internal resistor R1 and the PTAT current IPTAT generated using the external resistor RPTAT is as follows.

$$IBGT = \left(\frac{IPTAT}{IPTAT^*}\right) \cdot IBGR^* \quad \text{[Equation 1]}$$

Currents flowing through the drains of the MOS transistors M31, M32, M33 and M34 of the current multiplier 130 operated in the sub-threshold region, shown in FIG. 7, satisfy the relationship represented as follows.

$$I_1 \cdot I_3 = I_2 \cdot I_4 \quad \text{[Equation 2]}$$

Equation 2 can be arranged as follows.

$$I_3 = \left(\frac{I_2 + I_3}{I_1 + I_4}\right) \cdot I_4 \quad \text{[Equation 3]}$$

To extract the BGR current IBGR from the PTAT current IPTAT, the analogous PTAT current IPTAT* and the analogous BGR current IBGR*, assume the following equations.

$$I_2+I_3=IPTAT/k_2 \quad \text{[Equation 4]}$$

$$I_1+I_4=IPTAT^*/k_2 \quad \text{[Equation 5]}$$

$$I_4=IBGR^*/k_1 \quad \text{[Equation 6]}$$

Equation 7 can be obtained using Equations 5 and 6.

$$I_1=(IPTAT^*/k_2)-(IBGR^*/k_1)$$

Equation 8 can be obtained using Equations 1, 3, 4 and 5.

$$I_3=IBGR/k_1 \quad \text{[Equation 8]}$$

Here, k1 and k2 are controlled such that the currents $I_1$, $I_2$, $I_3$ and $I_4$ flowing through the drains of the MOS transistors M31, M32, M33 and M34 are less than 5 μA because the four MOS transistors M31, M32, M33 and M34 must be operated in the sub-threshold region and current in the sub-threshold region is less than 5 μA.

Referring to Equations 4, 5, 6, 7 and 8, the current IPTAT*/k2-IBGR*/k1 corresponding to the difference between the analogous PTAT current in the second ratio IPTAT*/k2 and the analogous BGR current in the first ratio IBGR*/k1 is provided as the current $I_1$ flowing through the drain of the MOS transistor M31, and the analogous BGR current in the first ratio IBGR*/k1 is provided as the current $I_4$ flowing through the drain of the MOS transistor M34. Furthermore, the analogous PTAT current in the second ratio IPTAT*/k2 is provided as the current source $I_2+I_3$ applied to the node between the sources of the MOS transistors M31, M32, M33 and M34 and the ground electrode. Accordingly, the BGR current in the first ratio IBGR/k1 can be obtained as the current $I_3$ flowing through the drain of the MOS transistor M33. Therefore, the BGR current IBGR can be easily obtained by amplifying the current $I_3$ flowing through the drain of the MOS transistor M33 k1 times.

As described above, the circuit for generating reference current according to the present invention can generate the BGR current and PTAT current using a single external pad and a single external resistor to provide them to an analog integrated circuit or an RF integrated circuit. Accordingly, the number of external pads can be reduced to effectively decrease the package size and the package manufacturing costs of the analog integrated circuit or RF integrated circuit including the circuit for generating reference current of the present invention.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A circuit for generating reference current comprising:

a current providing unit for generating a PTAT current, mirroring the PTAT current to generate an analogous PTAT current, and generating an analogous BGR current;

a current ratio control unit for receiving the analogous BGR current, the PTAT current and the analogous PTAT current from the current providing unit to generate an analogous BGR current in a first ratio, a PTAT current in a second ratio and a current corresponding to the difference between the analogous PTAT current in the second ratio and the analogous BGR current in the first ratio; and a current increasing/decreasing unit for receiving the analogous BGR current in the first ratio, the PTAT current in the second ratio and the current corresponding to the difference between the analogous PTAT current in the second ratio and the analogous BGR current in the first ratio from the current ratio control unit, and increasing/decreasing the analogous BGR current in the first ratio, the PTAT current in the second ratio and the current corresponding to the difference between the analogous PTAT current in the second ratio and the analogous BGR current in the first ratio to generate a BGR current in the first ratio.

2. The circuit for generating reference current of claim 1, wherein the current ratio control unit comprises cascode current mirrors each of which includes MOS transistors, and the ratio of the channel widths of the MOS transistors of each cascode current mirror is controlled to provide the analogous BGR current in the first ratio, the PTAT current in the second ratio and the current corresponding to the difference between the analogous PTAT current in the second ratio and the analogous BGR current in the first ratio.

3. The circuit for generating reference current of claim 1, wherein the current increasing/decreasing unit comprises a current multiplier, including MOS transistors operated in a sub-threshold region.

* * * * *